United States Patent [19]

Rocha

[11] 4,043,249

[45] Aug. 23, 1977

[54] AMMUNITION CONVEYOR DRIVE CAM

[75] Inventor: John G. Rocha, Davenport, Iowa

[73] Assignee: The United States of America as represented by the Secretary of the Army, Washington, D.C.

[21] Appl. No.: 702,542

[22] Filed: July 6, 1976

[51] Int. Cl.[2] ..... F41D 9/02

[52] U.S. Cl. ..... 89/33 CA; 74/437

[58] Field of Search ..... 74/437; 89/33 BB, 33 BC, 89/33 C, 33 CA; 198/834, 835, 858, 859

[56] References Cited

U.S. PATENT DOCUMENTS 2,113,202 4/1938 Stange ..... 89/33 CA

*Primary Examiner*—Stephen C. Bentley

*Attorney, Agent, or Firm*—Nathan Edelberg; Harold H. Card, Jr.; Robert O. Richardson

[57] ABSTRACT

An ammunition feed conveyor drive assembly for automatic weapon systems employing a rotatable driving cam device and a smaller diameter rotatable driven cam device and in which both devices have dual tier cam surfaces which cooperate to cause a lower degree of angular revolution of the driven device compared to the degree of angular revolution of the driving device.

7 Claims, 7 Drawing Figures

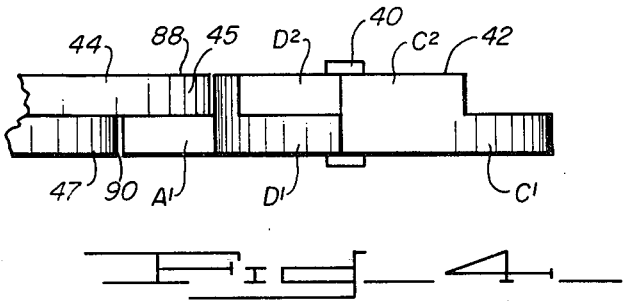
44
88
45
D2
40
C2
42
47
90
A1
D1
C1
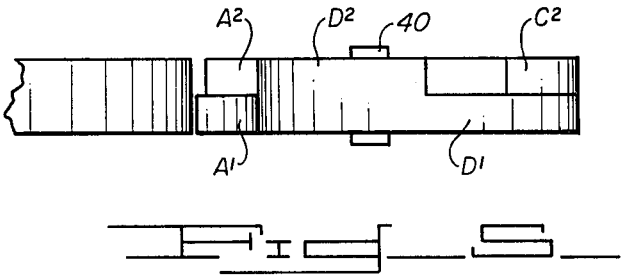
A2
D2
40
C2
A1
D1
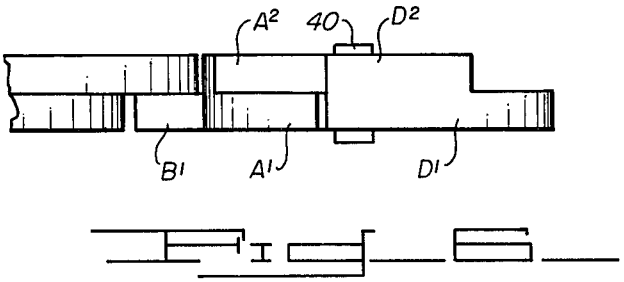
A2
40
D2
B1
A1
D1

AMMUNITION CONVEYOR DRIVE CAM

GOVERNMENT RIGHTS

The invention described herein may be manufactured and/or used by or for the Government for governmental purposes without the payment of any royalty thereon.

BACKGROUND OF THE INVENTION

Heretofore, difficulties have been encountered in the design of mechanisms for driving the feed of individual rounds of ammunition into the firing chamber area of automatic weapons. The feed and feed drive mechanisms had to be synchronized to the firing cycle demands of the weapon.

Prior attempts included spring loaded components or surfaces which subjected these feed mechanisms to vibrations or slippages due to external force loads to which the weapon was subjected, such as vibration effects if the weapon is vehicle mounted, and internal force loads such as recoil forces from the firing of the weapon. Such vibrations and slippages decrease considerably the synchronization of feed and weapon demand and, thus, the reliability of the weapon.

Other prior attempts to utilize cam devices synchronized to the movement of the recoiling parts of the weapon resulted in use of complicated reduction gear devices which not only added to the weight of the weapon but also reduced its reliability and introduced further problems of supply of additional repair and replacement parts.

SUMMARY OF THE INVENTION

These and other problems, difficulties and disadvantages of the prior art are subsantially overcome by employment of the present invention which comprises an ammunition feed tray conveyor drive assembly for automatic weapon systems including a large rotatable driving cam device and a smaller rotatable driven cam device which cooperate to produce rotary movement of the smaller cam device through a smaller predetermined number of degrees of revolution than the numbers of degrees of revolution of the larger driving cam device.

The driving cam device motion and operating cycle is synchronized to the operating cycle of the weapon and the ammunition firing cycle feed requirements of the weapon are translated to the ammunition feed conveyor system by the rotary movement of the smaller driven cam device in response to the camming action of the larger driving cam device.

The design and operation of the driving and driven cam devices is unique in that both devices have two tiered or stepped bearing faces or surfaces through a segment of their peripheries. The lower cam faces of the two devices engage to rotate the driven device through a predetermined angle while the upper faces of the two devices are disengaged. The upper cam faces of the two devices engage to continue rotation of the driven device through another predetermined angle, while the lower faces of the two devices are disengaged. The transistion from upper to lower, and vice versa, occurs without interruption to the rate of rotation of the two devices to feed ammunition into the feed tray of the weapon positively and reliably, and without the aid of spring loaded components or surfaces.

DESCRIPTION OF THE DRAWINGS

The foregoing features, objects, and advantages of the present invention will become readily apparent to one skilled in the art from a reading of the following description of a preferred embodiment of the present invention, when read in conjunction with the accompanying drawings, wherein like reference numerals and characters refer to like and corresponding parts throughout the several views and wherein:

FIG. 4 is a side view in elevation of the devices of FIG. 3 in their initial inactive positions, FIG. 5 is similar to FIG. 4 but illustrates the positions of the devices after the driving cam device has rotated 180° clockwise, FIG. 6 is similar to FIG. 5 but illustrates the positions of the devices after the driving cam device has rotated an additional 180° and the driven cam has rotated a quarter turn.

DESCRIPTION OF PREFERRED EMBODIMENT

Figure 1:
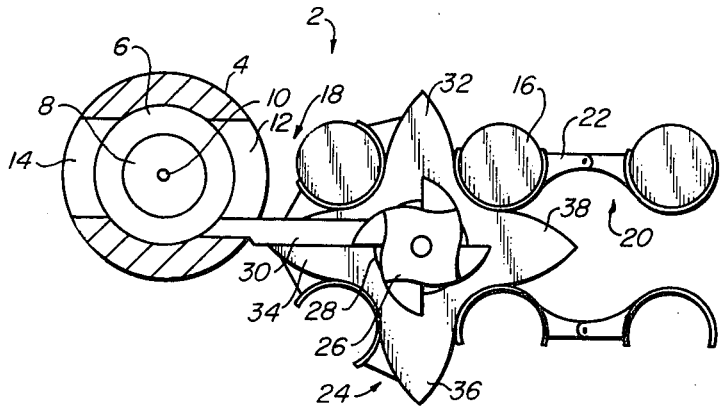
FIG. 1 is a schematic view illustrating a typical conveyor ammunition feed system of the lateral sprocket feed type for automatic weapons.

FIG. 1 illustrates schematically a weapon system, generally indicated by the numeral 2, which includes a receiver 4 circumscribing a firing chamber 6. The firing chamber 6 carries a bolt 8 and a firing pin 10. The receiver 4 has an ammunition feed inlet 12 for lateral feed of rounds individually into the firing chamber 6. The receiver also has an injection outlet 14 for spent casings.

Rounds 16 are fed onto a feed tray 18 communicating with the feed inlet 12 for introduction into the firing chamber area 6 by means of a conveyor system, generally indicated by the numeral 20. The conveyor system shown is of the continuous loop type comprising a series of pivotally connected conveyor elements 22, each of which picks up a round and carries the round under the influence of a conveyor sprocket drive assembly 24 to a point adjacent to the feed tray 18 where each round is removed from its conveyor element 22 and deposited on the feed tray 18.

The sprocket drive assembly 24 includes a rotatable drive shaft 26 carried in bearing means 28 formed in extensions 30 of the feed tray 18.

Figure 2:
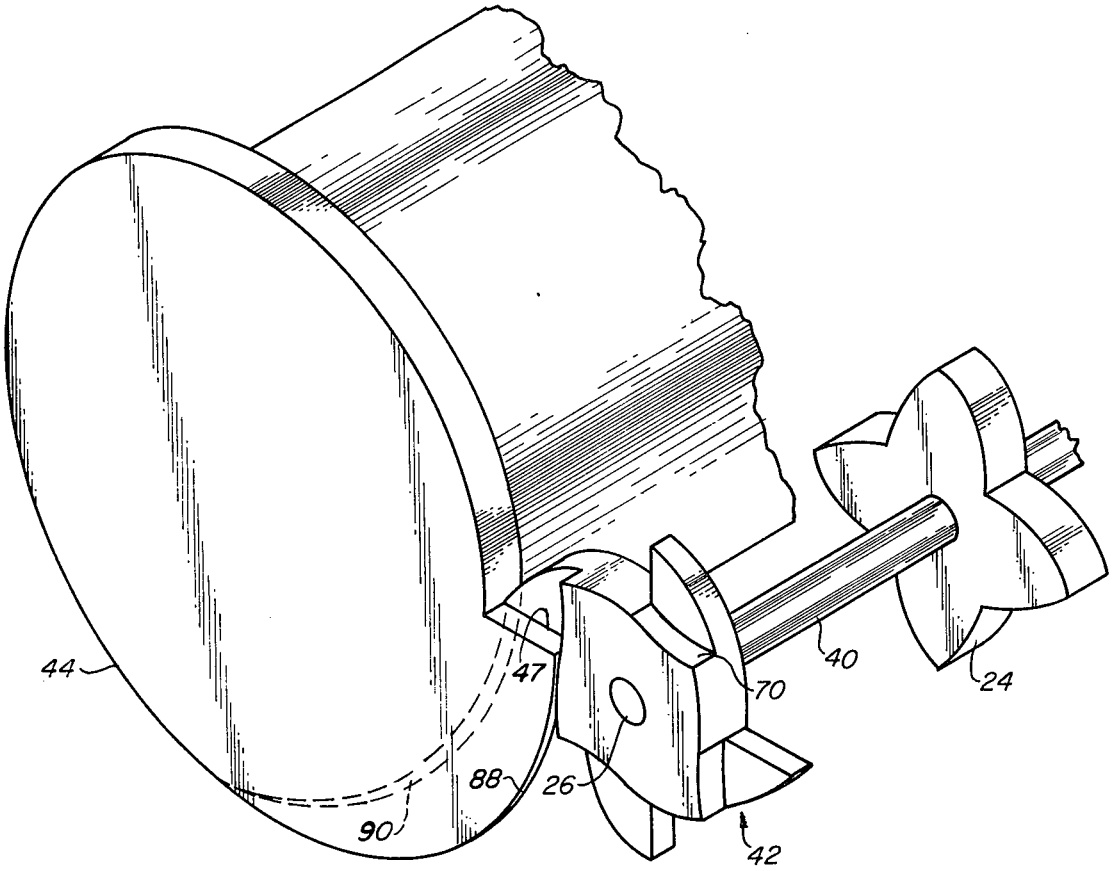
FIG. 2 is an exploded schematic illustrating one embodiment of the present invention.

In the embodiment shown in the drawing, the sprocket assembly 24 includes two spaced sprocket wheels of like configuration and each is provided with four identical teeth 32, 34, 36, and 38 located 90° from each adjacent tooth. Thus, for each 90° of counterclockwise movement of the sprocket shaft 26, each tooth will advance 90° and a round 16 between two adjacent teeth will be deposited on the feed tray 18. As viewed in FIG. 2, the drive shaft 26 of the sprocket assembly 24 is provided with an extension 40.

In accordance with the present invention, the sprocket extension 40 fixedly carries at its outer end a driven cam device 42 which is stepped or two tiered in cross section (FIGS. 3–6) to provide a plurality of bearing surfaces or faces, the structure and function of which will be described in detail hereinafter. The driven cam device 42 acts to move the teeth 32–38 of the wheels of the sprocket assembly 24 counterclockwise continuously through 360°.

A rotatable driving cam device 44 is provided which is shown mounted concentrically with the receiver 4. Means (not shown) are provided to rotate the driving cam device 44 unidirectionally and in synchronization with the firing demands of the weapon system so that the feeding of rounds is coordinated with such demands.

The driving cam device 44 is also stepped or two tiered in cross section throughout a segment of its periphery to define upper and lower cam bearing faces or surfaces. The upper camming surface 45 of the driving cam device 44 coacts with the upper cam surfaces of the driven cam device 42 to advance the driven cam device 42 and the lower camming surface 47 of the driving cam device 44 coact with lower cam surface of the driven cam device 42 also to advance the driven cam device.

Figure 3:
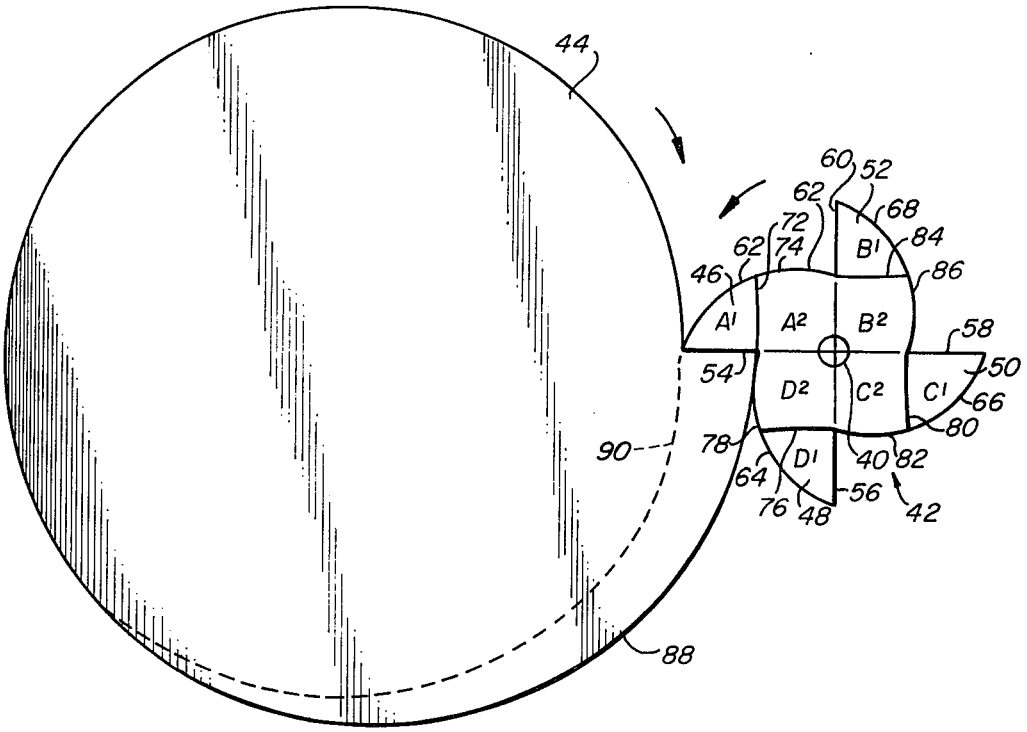
FIG. 3 is a plan view of the driving and driven cam devices of the present invention.

Referring to FIG. 3, the driven cam device 42 is provided with four teeth 46, 48, 50, and 52 each spaced 90° from the adjacent tooth. When device 42 is mounted on the sprocket shaft extension 40, these teeth 46–52 are axially aligned with the teeth 32–38 of the sprocket assembly 24, as clearly appears in FIG. 2. Thus, for each 90° of rotation of the driven cam device 42, the sprocket 32–38 will have also been rotated 90°.

Each tooth 46–52 has a linear side surface 54–60 and a connecting arcuate side surface 62–68. The linear sides 54–60 do not perform a cam function, whereas the arcuate sides 62–68 to perform a cam function.

An upper block 70 is superimposed on the driven cam device 42 above the teeth 46–52. Block 70 also is provided with arcuate cam surfaces and linear non-cam surfaces.

Adjacent to and above tooth 46, the block 70 is provided with a linear non-cam surface 72. Surface 72 connects with an arcuate cam surface 74 which has an arcuate surface continuity with the lower arcuate surface 62 of tooth 46 to provide a combined lower and upper arcuate cam surface to rotate the device 42 through 90°.

Similarly, block 70 has a second linear non-cam surface 76 adjacent to and above tooth 48 which connects with an arcuate cam surface 78. Surface 78 has an arcuate surface continuity with the arcuate surface 64 of the tooth 48 to define a second combined arcuate cam surface of 90°.

A third linear non-cam surface 80 is provided adjacent to and above tooth 50 which connects with an arcuate cam surface 82 to provide a surface continuity to define a third combined cam surface of 90° between surfaces 66 and 82.

Finally, a fourth linear non-cam surface 80 is provided adjacent to and above tooth 52 which connects with an arcuate cam surface 86 which has a surface continuity with arcuate cam surface 68 to define a fourth combined cam surface having a 90° arc.

Again referring to FIG. 3, the driving cam device 44 has an upper camming surface 88 which may be defined as a spiral starting at a point, 0°, which continuously rises to a point, 360°, which is 360° from point 0° and which then falls back to point 0° to initiate another 360° spiraling cycle.

In the example illustrated in FIG. 3, the cam driving device 44 has basically a nine inch diameter at point 0° with an upper peripheral spiral camming surface extension beginning at point 0° and rising 0.00208 inches per degree of rotation for a total of a 0.75 inch rise, per clockwise revolution, to point 360°. In the embodiment shown in the drawing, the upper camming surface 88 of the driving cam device 44 continuously functions through the last 160° of rotation of the driving cam device 44, per each 360° revolution, to cam each of the upper cam surfaces 74, 78, 82, 86, of the smaller driven cam device 42 through approximately 45° degrees of rotation.

Figure 7:
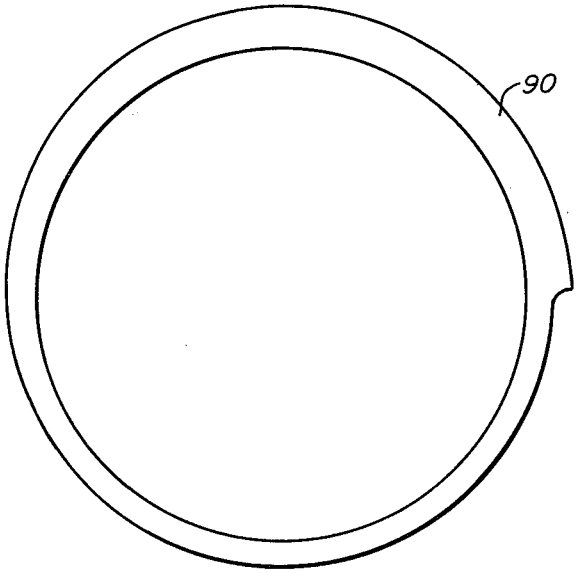
FIG. 7 is a bottom view of the driving cam device showing the lower camming surface.

The lower camming surface 90 of the drive cam device 44, as shown in FIG. 7, is also a spiral extending from point 0° and rising 0.00208 inches per degree of rotation from point 0° to point 200°. The lower camming surface 90 of the driving cam device 44 continuously functions through the initial 200° of rotation of the driving cam device 44 per each 360° revolution, to cam each of camming surfaces 62, 64, 66 and 68 of the driven cam device 42 through 45° of rotation.

It will be appreciated that the large master driving device 44 has a vertically extending interrupted side wall face or surface which is the camming surface for the smaller cammed driven member 42. The upper and lower cam paths defined by the camming surface of the driving member may be defined as spiral paths generated by a point moving about the fixed center axis of the drive member having a predetermined increasing rise during each 360° revolution of the drive member and which upon completion of each 360° cycle falls to its initial position.

As viewed in FIG. 4, the lower portion of the side wall face or surface is slotted or recessed beginning at the 200° point to permit the next succeeding tooth of the driven cam device to follow a dwell path until the preceding upper bearing surface is disengaging from the upper camming surface 88 of the driving cam device 44 whereupon the dwelling lower cam bearing surface of the next succeeding tooth is engaged by the lower surface 90 of the driving cam device at point 0° as the second lower dwelling cam step leaves the dwelling slot.

In the position shown in FIG. 3 the master driving cam device 44 has just completed rotating through 360° indicated by the horizontal line to complete a cycle of rotation of the driven cam device 42. The lower bearing surface A1 of driven cam device 42, on continued clockwise rotation of the driving cam member 44, engages the lower camming surface 90 of device 44 and is movably cammed thereby through 45° of rotation while device 44 rotates 200°. After the driving cam device has rotated through 200° the cam function is then transferred to the upper cam bearing surface A2 which begins to engage the upper camming surface 88 of the driving member 44 to drive the driven cam device 44 through another 45° of rotation while the driving cam device 44 rotates through 160°. When the upper bearing surface has rotated through approximately 23° by contact with the upper bearing surface 90, the tip B1 of the next lower cammed tooth surface 48 of the driven cam member enters the lower slot 47 formed by the spiral segment of the driving cam member to prevent the tip B1 of the tooth surface 52 from interfering with the continued rotation of the upper cam surface A2 through the remainder of the 45° of its camming action. When the surface A2 has completed its movement through 45°, the driven cam device 42 has rotated only 90°, and in turn has rotated the sprocket 24 90° to feed another round to the feed tray while the driving device 44 has rotated 360°. After the device 44 has rotated 360° the cam surface of tooth B1 and is now engaged by the lower camming surface 90 of the driving member 44 to rotate the tooth B1 through its 45° angle. After the tooth B1 has been rotated 45°, the camming function is assumed by the upper bearing cam surface B2 to complete the rotation of the driven member 42 through another 45° for a total of 180°. When bearing surface B2 has been rotated 23°, the tip C1 of the tooth of lower cammed surface 50 enters the slot of the driving member and thereby also avoids interfering with the continued rotation of the driving and driven cam member. Upon completion of camming of upper cam bearing surface B2 though its remaining 45°, lower bearing surface C1 is engaged by the lower camming surface 90 of the driving member 44 to begin its rotation through 45°. Upon completion of rotation through 45° of the lower cammed surface C1, the camming function is transferred to the upper cam bearing surface C2 and the upper camming surface 88 of the driving member 44 begins to cam bearing surface C2 through its 45° of rotation. When bearing surface C2 has been cammed 23°, the tip of the tooth of the lower bearing surface D1 enters the slot to avoid interfering with continued rotation of the driving and driven members. When the cam bearing surface C2 has been rotated through its final 45°, the lower cam bearing surface D1 is engaged by the lower camming surface of the driver 44 and is rotated through 45° whereupon the camming function is then transferred to the upper bearing surface D2 and upper bearing surface 88 to complete another 45° of rotation of the driven member 42.

Upon completion of 23° rotation of the surface D2, the tooth A1 is entering the slot to begin another 360° cycle of revolution of the driving member. When the surface D2 has completed its 45° of rotation, the driving member 44 has completed a fourth revolution of 360° so that for each full revolution of 360° of the driving member 44, the driven member 42 completes only a ¼ turn or, in the embodiment shown in the drawing, is rotated through only 90°.

I claim:

1. An ammunition feed conveyor drive assembly for automatic weapon systems including rotatable feed means for sequentially feeding rounds laterally and individually into a receiver opening of the weapon, rotatable driven cam means for rotating said rotatable feed means and having a plurality of cam surfaces, and rotatable cam driving means having a plurality of cam surfaces for engagement with selected cam surfaces of said driven cam means to rotate said driven cam means and thereby said feed means, said driven cam means having a smaller diameter than said driving cam means, said cam surfaces of said driving and driven means coacting to rotate said driven means through a smaller angle of rotation than the angle of rotation of said driving means, both said driving and driven cam means having interrupted upper and lower cam bearing surfaces, said upper cam bearing surfaces of the driving and driven cam means cooperating to rotate said driven cam means through a predetermined angle, said lower cam bearing surfaces of the driving and driven means cooperating to rotate said driven means through a predetermined angle.

2. The assembly of claim 1 wherein the combined angle of rotation of said upper and lower cam surfaces of said driving cam means is approximately 360° and the combined angle of rotation of said driven cam means is less than 360° for each 360° revolution of said driving cam means.

3. The assembly of claim 2 wherein the combined angle of rotation of said driven cam means is 90° for each 360° revolution of said driving cam means.

4. The assembly of claim 3 wherein the upper cam surface of the driving cam means is a spiral defining a cam path rising in dimension between 0° and 360° and when falling again at 0°.

5. The assembly of claim 4 wherein the lower cam surface of the driving cam means is a spiral defining a cam path beginning at the 0° initiation of the cam function, then after a predetermined rise, the cam surface is cut away to prevent contact with the point of the lower cam surface of the following driven cam tooth-type bearing surface at which cut-away point, the camming function is transferred to the upper cam surface.

6. The assembly of claim 5 wherein the lower cam bearing surface of the driven cam means comprises four spaced teeth which extend 90° from each other, each of said teeth having an arcuate cam bearing surface for engagement with the lower cam surface of the driving cam means to rotate the driven cam means through 45°.

7. The assembly of claim 6 wherein the upper cam bearing surface of said driven means comprises four spaced arcuate upper bearing surfaces, each of said bearing surfaces having a surface continuity with one of said teeth for engagement with the upper cam bearing surface of the driving cam means to rotate the driven cam means through a second 45°.

* * * * *